US006054815A

United States Patent [19]

Sugita et al.

[11] Patent Number: 6,054,815

[45] Date of Patent: Apr. 25, 2000

[54] BALLAST FOR A DISCHARGE LAMP

[75] Inventors: Kazushige Sugita; Masataka Ozawa, both of Hyogo; Masayoshi Gyoten, Shiga; Masanobu Murakami, Osaka, all of Japan

[73] Assignee: Matsushita Electric Industrial., Ltd., Osaka, Japan

[21] Appl. No.: 09/281,466

[22] Filed: Mar. 30, 1999

[30] Foreign Application Priority Data

Apr. 1, 1998 [JP] Japan ..... 10-088884

[51] Int. Cl.[7] ..... H05B 37/00

[52] U.S. Cl. ..... 315/244; 315/224; 315/209 R; 315/DIG. 7

[58] Field of Search ..... 315/307, 291, 315/209 R, 278, 224, 244, 219, DIG. 4, DIG. 7

[56] References Cited

U.S. PATENT DOCUMENTS

| | | | |
|---|---|---|---|
| 5,404,082 | 4/1995 | Hernandez et al. | 315/219 |
| 5,448,137 | 9/1995 | Bobel | 315/244 |
| 5,469,028 | 11/1995 | Nilssen | 315/291 |
| 5,914,572 | 6/1999 | Qian et al. | 315/307 |
| 5,920,155 | 7/1999 | Kanda et al. | 315/307 |
| 5,925,984 | 7/1999 | Fischer et al. | 315/219 |

FOREIGN PATENT DOCUMENTS 3-276598 12/1991 Japan .

*Primary Examiner*—Haissa Philogene
*Attorney, Agent, or Firm*—Merchant & Gould P.C.

[57] ABSTRACT

A ballast for a discharge lamp comprises a smoothing capacitor, an inverter circuit including at least one switching device connected in parallel to the smoothing capacitor, a driving circuit for driving the inverter circuit, an activating circuit for activating the driving circuit, a resonance circuit including first and second capacitors and an inductor connected to output terminals of the inverter circuit, a discharge lamp connected to output terminals of the resonance circuit, a third capacitor connected in parallel to the discharge lamp. A fourth capacitor and first and second rectifying elements connected in series are connected in parallel to the smoothing capacitor. Between both terminals of the fourth capacitor and terminals for connection to an AC power source, a filter and a rectifier are inserted. A terminal of the first capacitor other than that connected to the inverter circuit is connected to a junction of the first and second rectifying elements.

11 Claims, 11 Drawing Sheets

BALLAST FOR A DISCHARGE LAMP

BACKGROUND OF THE INVENTION

1. Field of the Invention

The present invention relates to a ballast for a discharge lamp using an inverter circuit.

2. Description of the Prior Art

A circuit as shown in FIG. 11 is conventionally known as a ballast for a discharge lamp, where a chopper circuit 4 and an inverter circuit 5 share a switching device 51. This circuit is disclosed in Japanese Laid-Open Patent Publication (Tokkai-Hei) No. 3-276598 and is designed to have a high power factor as to an input voltage applied to a discharge lamp 6 and reduce harmonic components.

The circuit configuration of the ballast as mentioned above will be described specifically below. Referring to FIG. 11, transistors 50 and 51, which function as first and second switching devices respectively, are connected in series so as to constitute the inverter 5. The inverter 5 is connected in parallel to a smoothing capacitor 55. A driving circuit 8 is connected to the inverter circuit 5 to drive it. A resonance circuit 7 includes a capacitor 52 and an inductor 53 that are connected to the outputs of the inverter circuit 5. A discharge lamp 6 is connected to the output of the resonance circuit 7 and a capacitor 54 is connected in parallel to the discharge lamp 6. The output terminals of a rectifier 3, which is connected to an AC power source 1 via a noise filter 2, are connected to the source and the drain of the transistor 51 via the inductor 41.

Next, the operation of the above-described circuit will be described. An input from the AC power source 1 passes through the filter 2 and is subjected to full-wave rectification in the rectifier 3. The resultant ripple voltage is applied to the chopper circuit 4, so that the smoothing capacitor 55 is charged via the inductor 41. When a DC voltage is applied to the smoothing capacitor 55, the driving circuit 8 supplies a control signal so that the transistors 50 and 51 of the inverter circuit 5 alternate on and off repeatedly.

When the transistors 50 and 51 alternate on and off repeatedly in response to the control signal supplied from the driving circuit 8, an AC voltage is applied to the resonance circuit 7 including the capacitor 52 and the inductor 53 connected to the output terminals of the inverter circuit 5. As a result, a voltage and a current limited by the capacitor 52 or the inductor 53 are supplied to the discharge lamp 6 connected to the output terminal of the resonance circuit 7 so that the discharge lamp 6 lights. The capacitor 54 is connected in parallel to the discharge lamp 6 for the purpose of generating a voltage to start the discharge lamp 6 and stabilizing the lighting circuit.

In the above-described operation, when an instantaneous voltage of the AC power source 1 is low, the increase rate of the current that flows in the inductor 41 is low. Therefore, the energy accumulated in the inductor 41 for a fixed period is small when the transistor 51 turns off, so that the charging voltage to the smoothing capacitor 55 drops. At this time, the input current becomes small in accordance with the instantaneous voltage of the AC power source 1.

When an instantaneous voltage of the AC power source 1 is high, the increase rate of the current that flows in the inductor 41 is high. Therefore, the energy accumulated in the inductor 41 for a fixed period is large when the transistor 51 turns off, so that the charging voltage to the smoothing capacitor 55 increases. The input current becomes large in accordance with the instantaneous voltage of the AC power source 1.

Therefore, input current with a waveform similar to the voltage waveform of the AC power source 1 can be obtained. Thus, the input power factor as to the power source can be high and the harmonic components of the input current from the power source can be reduced.

However, the conventional ballast described above poses a problem in that the configuration is complex so that it can result in a large-scale and expensive device. Furthermore, when a source voltage is applied to the ballast via a dimmer, the voltage of the smoothing capacitor is likely to drop so that the operation becomes unstable. For this reason, a dimmer is difficult to use with the device.

SUMMARY OF THE INVENTION

Therefore, in consideration of the foregoing, it is an object of the resent invention to provide a ballast for a discharge lamp having a simple configuration that can start and maintain the lighting of a discharge lamp safely, and allows the use of a dimmer.

A ballast for a discharge lamp of the present invention comprises a smoothing capacitor, an inverter circuit including at least one switching device connected in parallel to the smoothing capacitor, a driving circuit for driving the inverter circuit, a resonance circuit including first and second capacitors and an inductor connected to output terminals of the inverter circuit, a discharge lamp connected to output terminals of the resonance circuit, and a third capacitor connected in parallel to the discharge lamp. Further a fourth capacitor and first and second rectifying elements connected in series are connected in parallel to the smoothing capacitor. Between both terminals of the fourth capacitor and terminals for being connected to an AC power source, a filter and a rectifier are inserted. A terminal of the first capacitor other than that connected to the inverter circuit is connected to a junction of the first and second rectifying elements.

It is preferable that the ballast further comprises an activating circuit for activating the driving circuit.

The first rectifying element is preferably a fast recovery diode, and the second rectifying element is preferably a fast recovery diode. The discharge lamp can be a preheat start type discharge lamp, and in that case the third capacitor is connected to the discharge lamp via a preheat electrode on the other side of the power source. A fifth capacitor is preferably connected in parallel to the discharge lamp.

Further, an inductor is preferably inserted between the fifth capacitor and the discharge lamp. The driving circuit for driving the inverter circuit preferably includes a transformer.

Further, in the case where a AC power source is connected to the device via a dimmer, the activating circuit preferably works at a voltage lower than a voltage at the filter caused as a result of voltage division between a capacitance of the dimmer and a capacitance of the filter. The smoothing capacitor preferably has a necessary breakdown voltage and a large capacitance. A fluorescent material having excellent persistence characteristics is preferably used in the discharge lamp. Preferably, a dimmer is further provided between the device and a commercial power source.

As described above, the ballast of the present invention has a simplified circuit configuration and allows input current to flow throughout all the cycles of a power source. The ballast has a high power factor as to input power source and can start and maintain lighting of a discharge lamp at reduced harmonic components of an input source current. Further the device allows dimming by using a dimmer for an incandescent lamp.

These and other advantages of the present invention will become apparent to those skilled in the art upon reading and understanding the following detailed description with reference to the accompanying figures.

DESCRIPTION OF THE PREFERRED EMBODIMENTS

Figure 1:
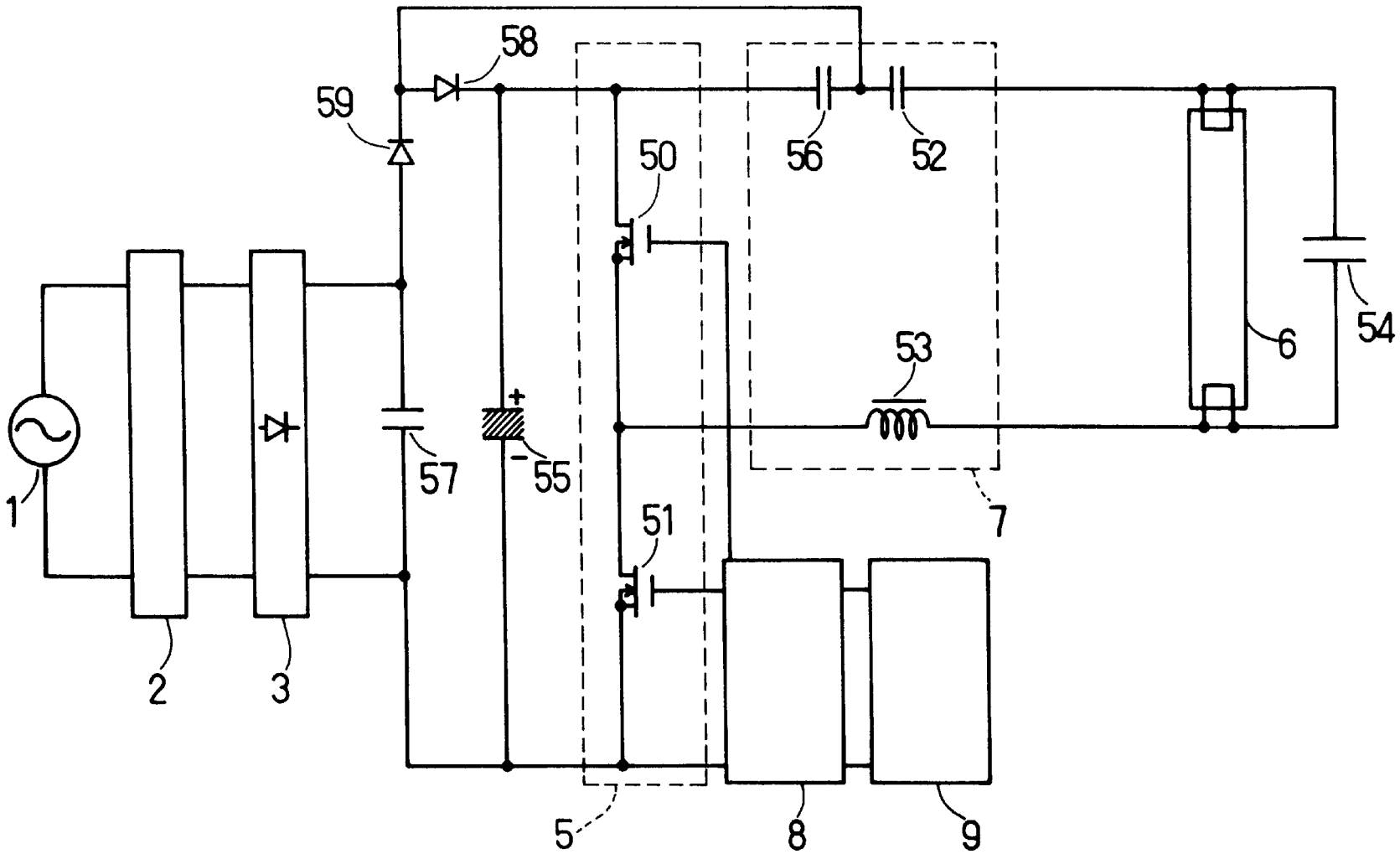
FIG. 1 is a circuit diagram of a ballast for a discharge lamp according to an embodiment of the present invention.
Figure 11:
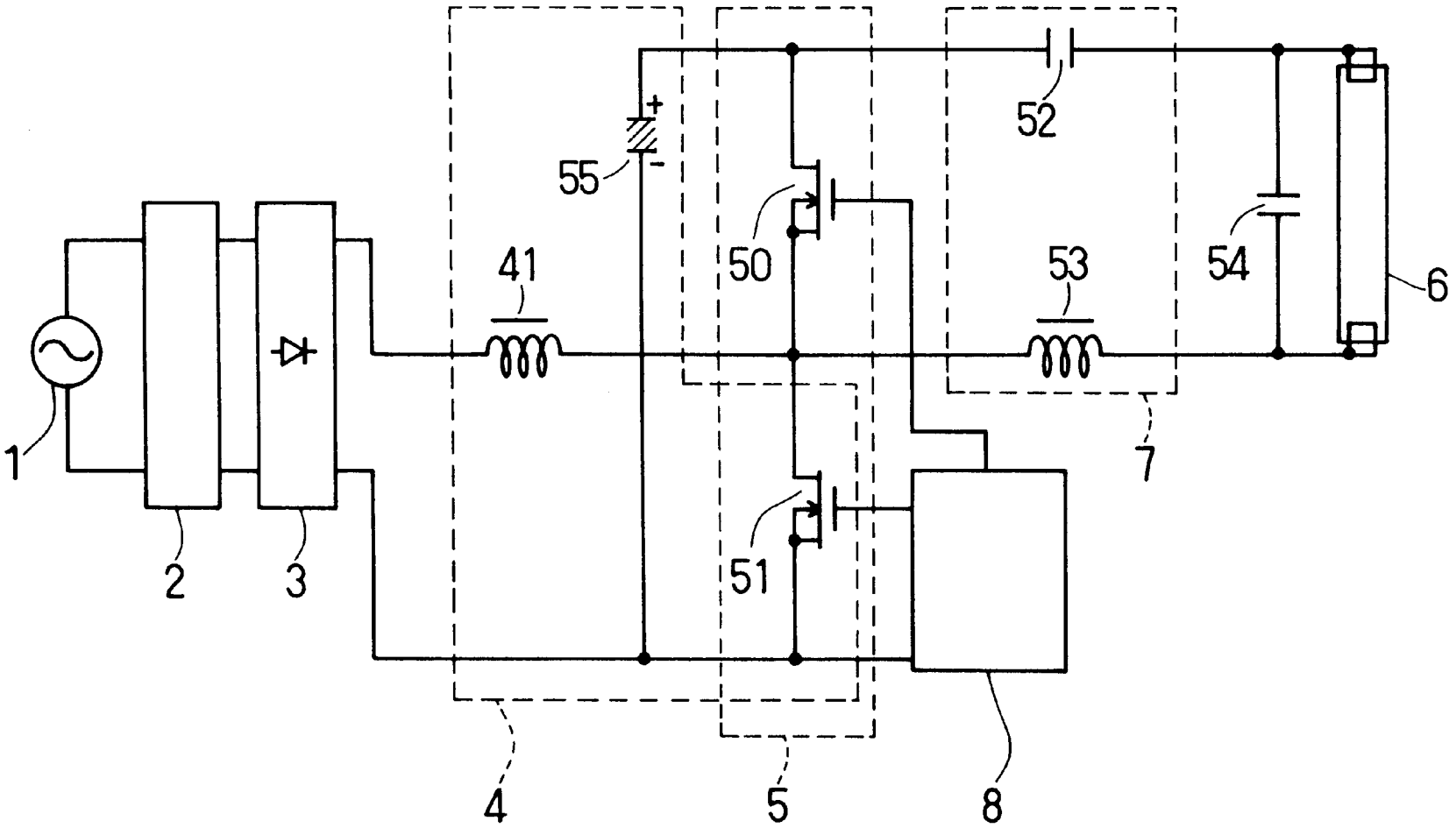
FIG. 11 PRIOR ART
FIG. 11 shows a circuit diagram of a conventional ballast for a discharge lamp.

FIG. 1 is a circuit diagram of a ballast for a discharge lamp according to an embodiment of the present invention. In FIG. 1, the same circuit components as those in FIG. 11 bear the same reference numerals. The differences between the embodiment of FIG. 1 and the conventional device of FIG. 11 are as follows:

The device of FIG. 1 does not include the inductor 41 as shown in FIG. 11. A capacitor 56 is inserted between the output terminal of the inverter circuit 5 and the capacitor 52. A fourth capacitor 57 and first and second diodes 58 and 59 connected in series are connected in parallel to the smoothing capacitor 55. The output terminals of the rectifier 3 is connected to the both terminals of the fourth capacitor 57. The junction of the first and second diodes 58 and 59 is connected to a junction of the capacitors 56 and 52. The operation of the ballast of FIG. 1 will be described below.

When power is supplied from the AC power source 1 to the rectifier 3 via the noise filter 2, it is full-wave rectified by the rectifier 3 and the resultant DC ripple voltage is supplied to the smoothing capacitor 55, so that the smoothing capacitor 55 is charged with the voltage. Upon application of the DC voltage to the smoothing capacitor 55, the activating circuit 9 works to activate the driving circuit 8. When the driving circuit 8 supplies a gate signal to the transistors 50 and 51 of the inverter circuit 5, the transistors 50 and 51 alternate on and off repeatedly.

The activating circuit 9 works as follows: When the smoothing capacitor 55 is charged by the voltage obtained by the full-wave rectification, the charged voltage is transmitted to the activating circuit 9 through stray capacitance and serial or parallel resistance of the components (56, 52, 54, 53, 50 and 51) and the driving circuit 8, causing the activating circuit 9 to generate activating signal. As means for transmitting the voltage applied from the rectifier 3, the activating circuit 9 can be actually connected to a junction located after the rectifier 3, such as the junction of the smoothing capacitor 55 and the diode 58, that of the diodes 58 and 59, or that of the diode 59 and the fourth capacitor 57.

Upon application of AC voltage to a resonance circuit 7 including the capacitors 56 and 52 and the inductor 53 connected to the output terminals of the inverter circuit 5, a voltage and a current limited by the capacitors 52 and 56 or the inductor 53 are supplied to a discharge lamp 6 connected to the output terminals of the resonance circuit 7. As a result, the discharge lamp 6 lights. The capacitor 54 is connected in parallel to the discharge lamp 6 for the purpose of generating a voltage for starting the discharge lamp 6 and stabilizing the operation of the lighting circuit.

In the starting and lighting operations of the discharge lamp, the DC voltage from the smoothing capacitor 55 is converted to a high frequency AC voltage. The high frequency AC voltage is generated by resonance current flowing through two closed loops alternately. One closed loop is constituted by the smoothing capacitor 55, the capacitors 56 and 52, the lamp 6 and the capacitor 54, the inductor 53 and the transistor 51. The other loop is constituted by the transistor 50, the inductor 53, the lamp 6 and the capacitors 54, 52 and 56.

The operation as described above is stable like a series inverter operation, which generally has been used in a conventional ballast with a low power factor. In the operation, the capacitor 56 is supplied with an AC voltage divided from resonance voltage, which has been divided between the capacitor 52 and the capacitor 56. Since the first diode 58 is connected in parallel to the capacitor 56, the AC voltage of the capacitor 56 is applied to the first diode 58. This voltage is superimposed on the charging path of the smoothing capacitor 55. Therefore, when the voltage at the cathode of the diode 58 is lower than that at the anode, the diode 58 is conducting so that the charging current flows from the rectifier 3 to the smoothing capacitor 55. When the voltage at the cathode of the diode 58 is higher than that at the anode, the diode 58 is out of conduction.

The first and second diodes 58 and 59 are inserted between the output terminal of the rectifier 3, i.e., the terminal of the fourth capacitor 57, and the terminal of the smoothing capacitor 55. When the voltage of the smoothing capacitor 55 becomes lower than the output voltage of the rectifier 3, the rectifier 3 supplies the charging current to the smoothing capacitor 55 via the first and second diodes 58 and 59. In this manner, the smoothing capacitor is charged by the effect of pulling the charging current throughout all the cycles of the AC power source.

The second diode 59 is inserted for the purpose of suppressing the influence of the fourth capacitor 57 on the resonance circuit 7. The effect of pulling the high frequency current from the rectifier 3 can be brought, as described above, by selecting a capacitance that causes a ripple in full-wave rectified voltage waveform as a capacitance of the fourth capacitor 57. Thus, the pulled current at a low wave height of the commercial power source can be increased. Furthermore, since the fourth capacitor 57 is connected in parallel to the smoothing capacitor 55 having a large internal resistance via the first and second diodes 58 and 59, when large current is needed, for example, to start the discharge lamp 6, the combined resistance of the resonance circuit drops so that a larger starting voltage can be applied to the discharge lamp 6.

The high frequency charging current is averaged by the filter 2. Thus, a part of the resonance voltage is fed back between the rectifier 3 and the smoothing capacitor 55 while the DC voltage of the smoothing capacitor 55 is converted to a high frequency AC voltage to light the discharge lamp 6, so that the smoothing capacitor 55 can be charged with high frequency. As a result, input current flows throughout all the cycles, so that the power factor is high, and the input current results in a sine wave with a small THD (total harmonic distortion).

Furthermore, the ballast of the present invention can be used with a dimmer for an incandescent lamp without problems. The dimmer for an incandescent lamp performs phase control, primarily using a triac, and therefore in a circuit with a low power factor, the dimmer is prone to malfunction because the triac is not brought into normal conduction. On the other hand, the ballast of the present invention has a high power factor, and the input current flows without interruption in the same manner as in the incandescent lamp. Therefore, even if the ballast of the present invention is connected with a dimmer, no malfunction occurs. Since the smoothing capacitor 55 is charged with a voltage increased by resonance, the discharge lamp 6 can light stably even under a high degree of dimming.

A fast recovery diode can be used for the first diode 58 to ensure the effect of the resonance current at the resonance circuit on the charging path for the smoothing capacitor 55. Furthermore, the heat generation of the diode 58 itself can be reduced.

A fast recovery diode is preferably used for the second diode 59 as well. This leads to reduced influence of the resonance current and a higher power factor and a lower THD. Furthermore, the heat generation of the diode 59 itself can be reduced, thus contributing to high efficiency.

Figure 2:
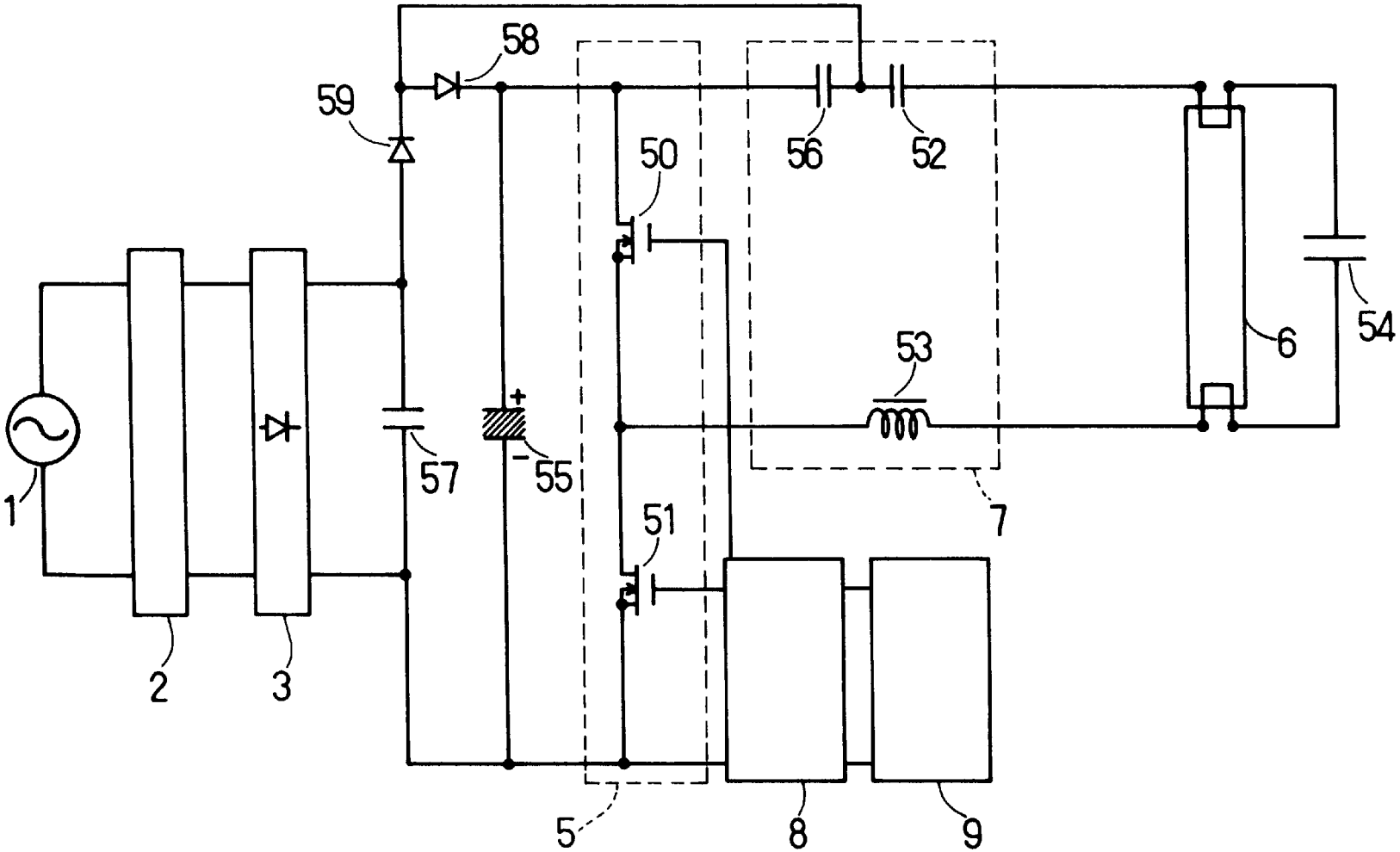
FIG. 2 is a circuit diagram of a ballast for a discharge lamp according to another embodiment of the present invention.

When the discharge lamp 6 is of a preheat start type, as shown in FIG. 2, the third capacitor 54 is preferably connected to the discharge lamp 6 on the side opposite to the power source via a preheat electrode. This makes it possible to prevent the increase of the discharge lamp voltage that otherwise may be required to be increased in response to the drop of the temperature of the preheat electrode when the preheat start type discharge lamp is dimmed, i.e., operated with low current. Thus, the wear of the preheat electrode and a discharge auxiliary, i.e., an emitter, can be reduced and the lifetime can be prolonged.

Figure 3:
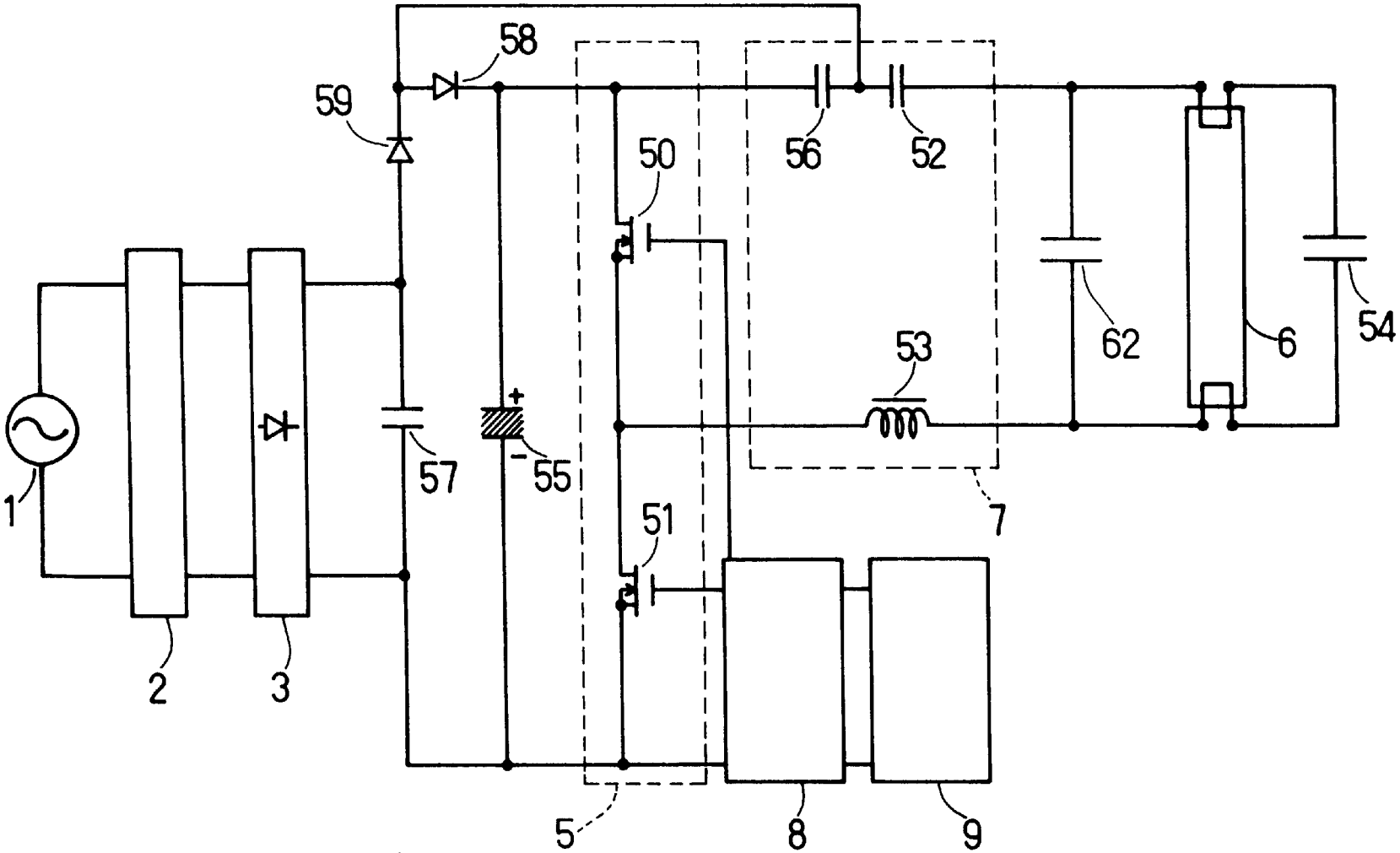
FIG. 3 is a circuit diagram of a ballast for a discharge lamp according to another embodiment of the present invention.

As shown in FIG. 3, a fifth capacitor 62 can be further connected in parallel to the discharge lamp 6 on the side of the power source so that the fifth capacitor 62 supplies a voltage for maintaining discharge. This embodiment makes it possible to avoid a non-discharge state, i.e., a preheat state at a high degree of dimming, i.e., during lighting with low illumination. Therefore, this embodiment is particularly advantageous when the degree of dimming is such that an optical output becomes lower than 10% of the rated optical output.

Figure 4:
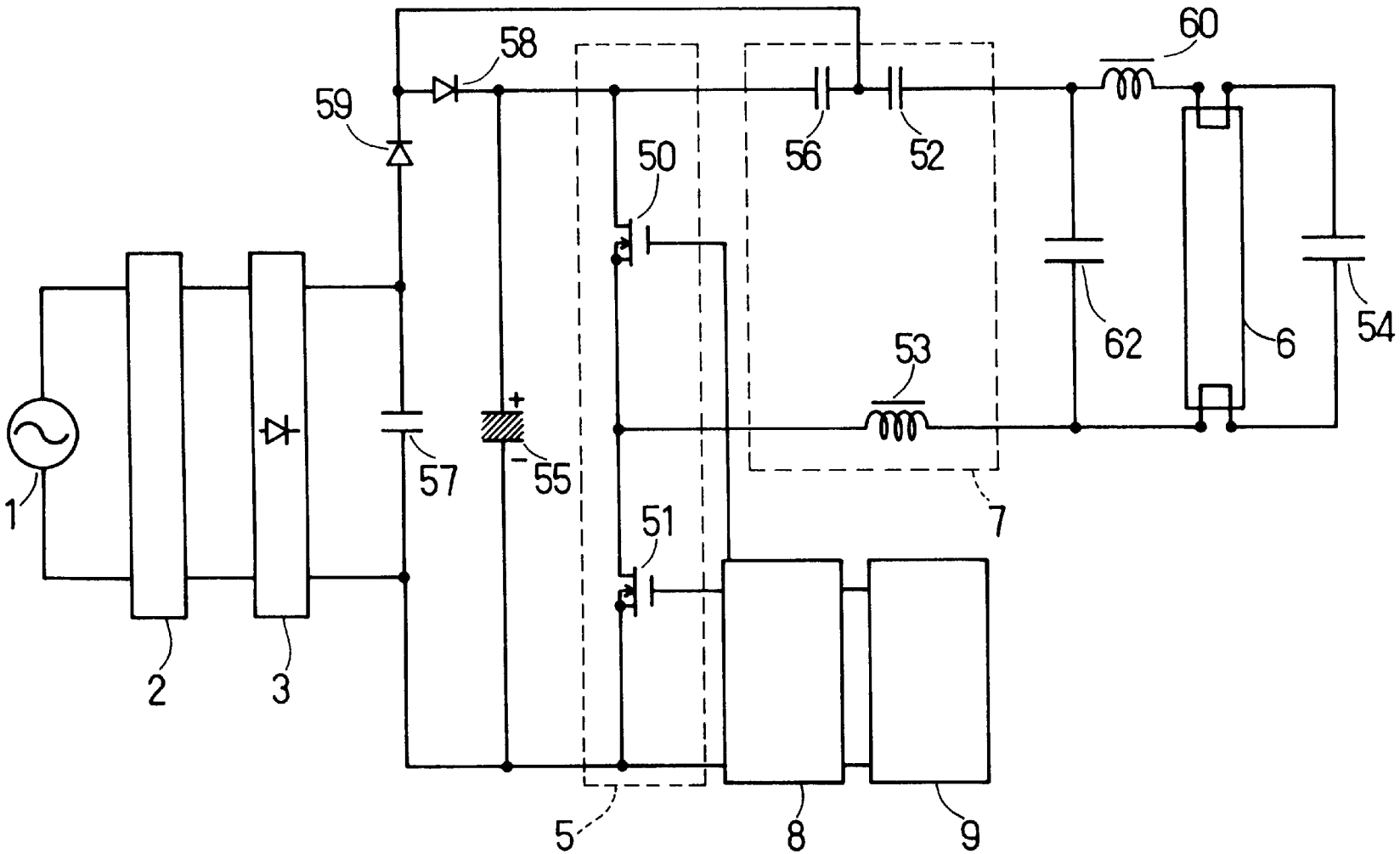
FIG. 4 is a circuit diagram of a ballast for a discharge lamp according to another embodiment of the present invention.
Figure 8:
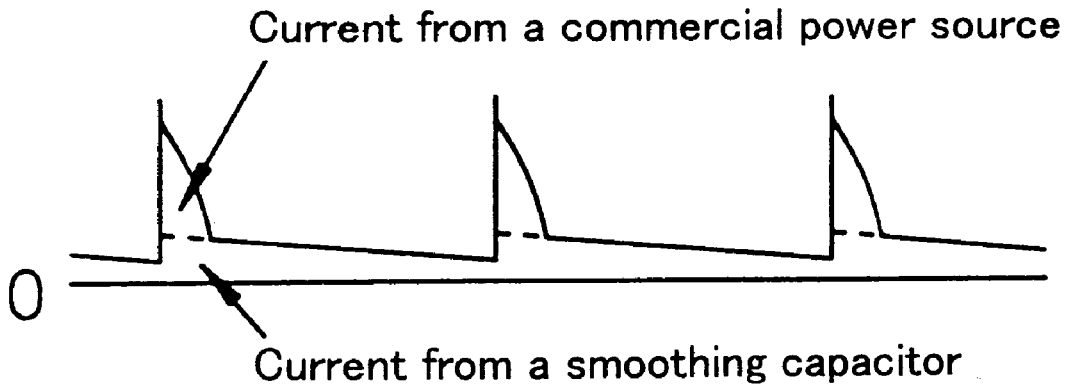
FIG. 8 shows a waveform of a discharge lamp current at a high degree of dimming.

As shown in FIG. 4, an inductor 60 can be inserted between the fifth capacitor 62 and the discharge lamp 6 so that the surge of the discharge lamp current, as shown in FIG. 8, at a high degree of dimming, i.e., during lighting with low illumination, is reduced. As a result, the wear of the electrode can be suppressed, so that the lifetime is prolonged, and variations in the optical output can be reduced.

Figure 5:
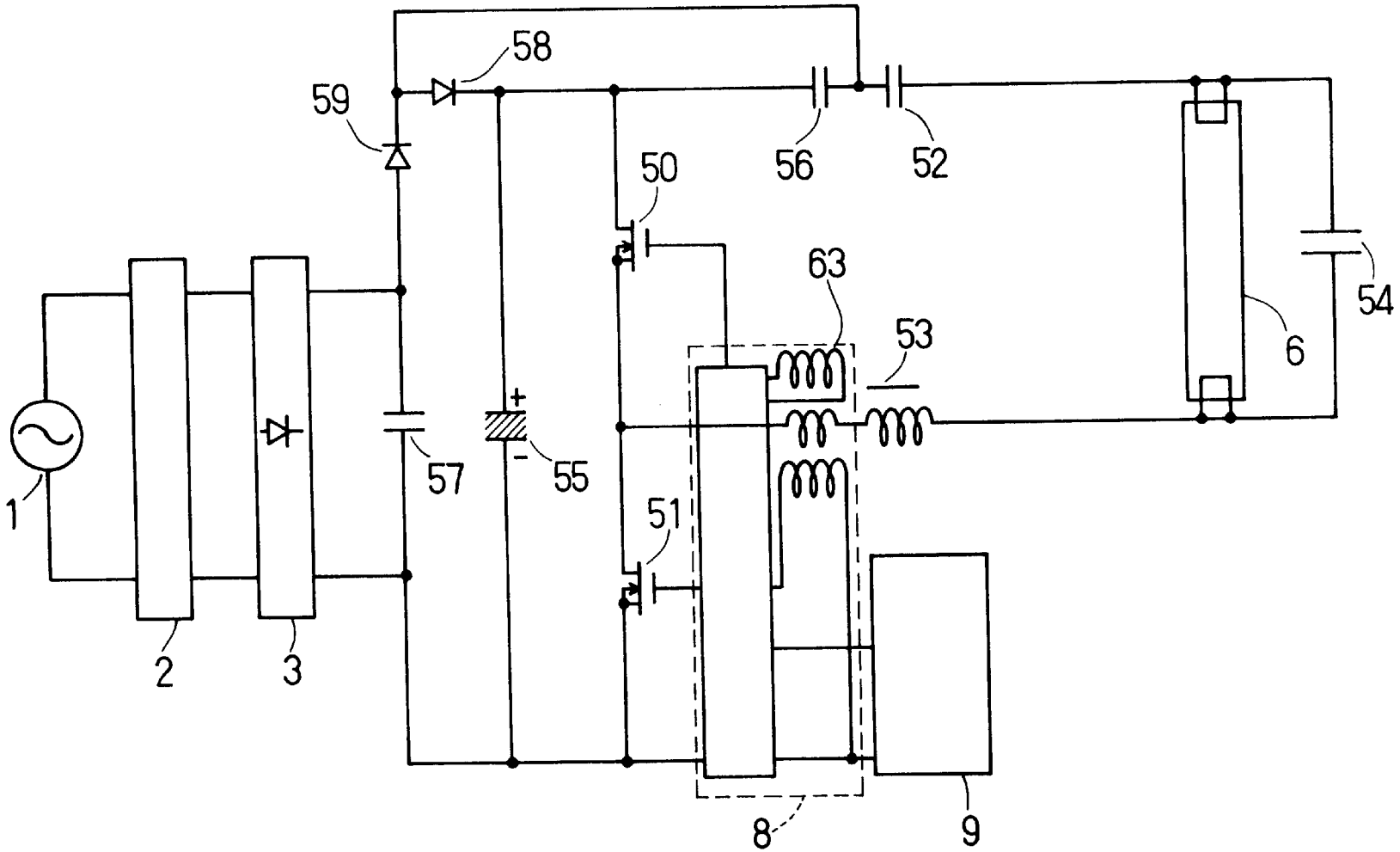
FIG. 5 is a circuit diagram of a ballast for a discharge lamp according to another embodiment of the present invention.

As shown in FIG. 5, the driving circuit 8 for driving the inverter circuit preferably includes a transformer 63. The relations among sources of operation power supply and paths of operation current are complicated in each phase of the commercial power source and each phase of high frequency operations. Therefore smooth control can be achieved with a simplified driving circuit with the transformer 63 rather than a separate excitation type driving circuit that performs complex control.

In FIG. 5, the transformer 63 is inserted between the output of the inverter circuit and the inductor 53. However, the transformer 63 can be inserted between the inductor 53 and the discharge lamp 6. Alternatively, the transformer 63 can be inserted in series with the third capacitor 54. In short, the transformer 63 is inserted such that high frequency current can be picked up. Furthermore, when the transformer 63 is provided with separate excitation control, the input current waveform can be formed more precisely.

Figure 6:
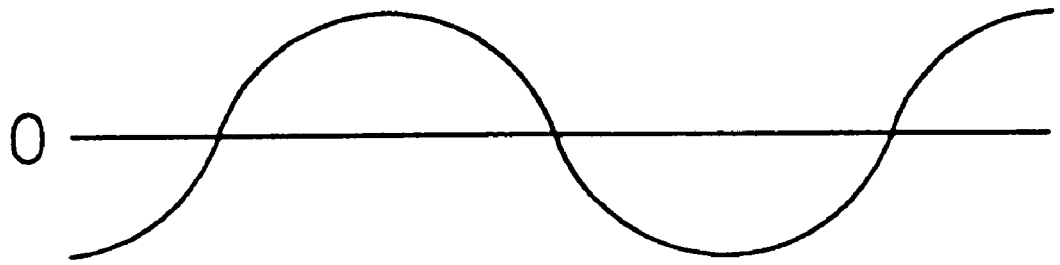
FIG. 6 shows a voltage waveform of a commercial power source.

When the ballast is used with a dimmer, it is preferable to design the circuit such that the activating circuit 9 operates to activate the driving circuit 8 at a voltage lower than a voltage generated at both terminals of the filter 2 as a result of dividing voltage between the capacitance of the dimmer and the capacitance of the filter 2. When the ballast is connected to a commercial power source with a sine wave as shown in FIG. 6, a voltage applied to the filter 2 of the ballast is generated as a result of dividing the voltage shown in FIG. 6 between the capacitance of the dimmer and the capacitance of the filter 2, before the ballast is activated.

Figure 7:
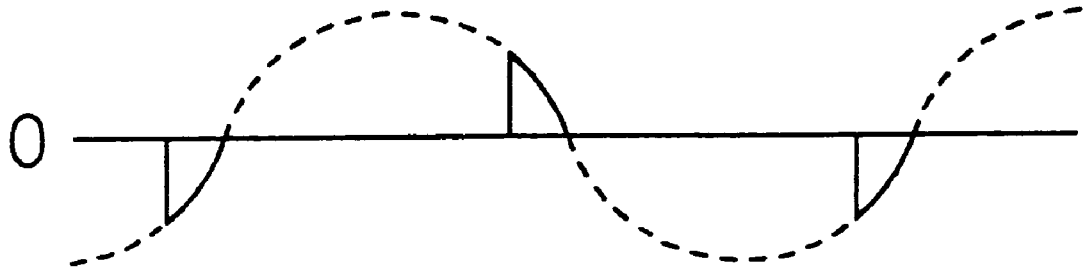
FIG. 7 shows an output voltage waveform of a dimmer.

Generally, when the dimming degree is small, no problem is caused because the effective voltage is large. On the other hand, when the dimming degree is large, the effective voltage is small, as shown in FIG. 7. Therefore, the current through the dimmer and the ballast is small so that the ballast does not operate normally. However, it is possible to start an operation at a low discharge current by designing the device such that the activating circuit 9 can operate at a voltage lower than the divided voltage.

For example, when the capacitance at both terminals of an external dimmer is 0.15 $\mu$F, the capacitance of the filter is 0.1 $\mu$F, and the voltage of a power source is 120 V, a voltage of 72 V is applied to the filter, i.e., the ballast, before the activating circuit operates. The voltage is calculated as follows: $120\times0.15/(0.15+0.1)=72$ (V). Therefore the ballast may be designed such that the activating circuit 9 can operate at a voltage of 72 V or less.

Furthermore, the smoothing capacitor 55 preferably has a breakdown voltage higher than 1.3 times of that applied during lighting by rated voltage. Also it preferably has a capacitance such that a ratio of peak value to root mean square value of a lamp current during lighting by a voltage of 90% of rated voltage becomes lower than 1.7. The larger capacitance is the more preferable. By virtue of such conditions, it is possible to reduce the heat generation of the smoothing capacitor 55 where high frequency charging current flows. As a result, inexpensive capacitors can be used rather than components with a high temperature rating or a high current rating.

Figure 9:
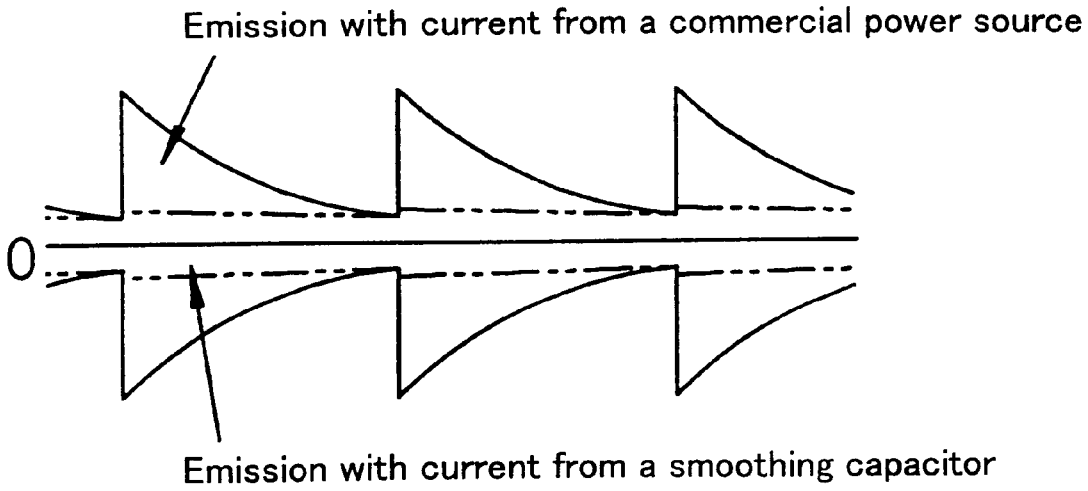
FIG. 9 shows a waveform of output light from a discharge lamp at a high degree of dimming.
Figure 10:
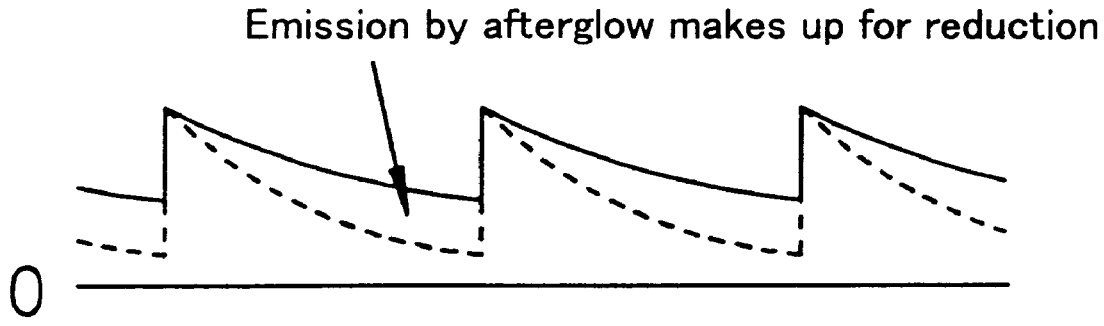
FIG. 10 shows an improved waveform of output light from a discharge lamp at a high degree of dimming.

A fluorescent material having excellent persistence characteristics is preferably used for the discharge lamp. As shown in FIG. 9, current that contributes to emission of light is mostly supplied by the commercial power source. By using a fluorescent material having such excellent persistence characteristics that the optical output is reduced to a half in 1.5 milliseconds or more, flicker can be reduced at the frequency of the commercial power source, as shown in FIG. 10, even if the ballast is used with a dimmer.

As described above, the present invention provides a ballast for a discharge lamp with a simplified circuit configuration that allows input current to flow throughout all the cycles, can start to light a discharge lamp and maintain the lightning at reduced harmonic components of the input current from the power source, and allows dimming with a dimmer.

In the embodiments described above, a series inverter system where two transistors are connected in series is used. However, inverters of other systems such as a push-pull inverter can be used. Alternatively, a single-transistor type inverter can be used. Furthermore, the driving circuit 8 may be a separate excitation type including a separate oscillation circuit, or a self-excitation type using a feedback signal from the resonance circuit 7. Alternatively, a driving circuit in combination of a separate excitation type and a self-excitation type can be used.

In the embodiments described above, the series resonance circuit comprising the capacitor and the inductance is used. However, a parallel resonance circuit can be used. Furthermore, the switching device is not limited to an FET, but other switching devices such as bipolar transistors may be used. The discharge lamp is not limited to a preheat start type discharge lamp, but a cold cathode start type discharge lamp, a low-pressure discharge lamp or a high-pressure discharge lamp may be used. Furthermore, the power source is not limited to a commercial power source, but other AC power sources (whose frequency is not either 50 Hz or 60 Hz) may be used.

The invention may be embodied in other forms without departing from the spirit or essential characteristics thereof The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A ballast for a discharge lamp comprising:

a smoothing capacitor;

an inverter circuit including at least one switching device connected in parallel to said smoothing capacitor;

a driving circuit for driving said inverter circuit;

a resonance circuit including first and second capacitors and an inductor connected to output terminals of said inverter circuit, said first and second capacitors being connected in series;

a discharge lamp connected to output terminals of said resonance circuit;

a third capacitor connected in parallel to said discharge lamp;

a fourth capacitor and first and second rectifying elements connected in series, which are connected in parallel to said smoothing capacitor; and a filter and rectifier inserted between both terminals of said fourth capacitor and terminals for connection to an AC power source;

wherein said first and second capacitors are disposed between said inverter circuit and an output terminal of said resonance circuit in a manner that said first capacitor is located on a side near to said inverter and a junction of said first capacitor and said second capacitor is connected to a junction of said first and second rectifying elements.

2. A ballast for a discharge lamp according to claim 1, further comprising an activating circuit for activating said driving circuit.

3. A ballast for a discharge lamp according to claim 1, wherein said driving circuit includes a transformer.

4. A ballast for a discharge lamp according to claim 1, wherein said first rectifying element is a fast recovery diode.

5. A ballast for a discharge lamp according to claim 1, wherein said second rectifying element is a fast recovery diode.

6. A ballast for a discharge lamp according to claim 1, wherein said discharge lamp is of a preheat start type, and said third capacitor is connected to said discharge lamp via a preheat electrode on a side opposite to the AC power source.

7. A ballast for a discharge lamp according to claim 6, wherein a fifth capacitor is connected in parallel to said discharge lamp on a side closer to the power source.

8. A ballast for a discharge lamp according to claim 7, wherein an inductor is inserted between said fifth capacitor and said discharge lamp.

9. A ballast for a discharge lamp according to claim 1, wherein said activating circuit operates at a voltage not more than a voltage generated in the filter as a result of dividing voltage between a capacitance of a dimmer and a capacitance of said filter, when the ballast is connected to an AC power source via the dimmer.

10. A ballast for a discharge lamp according to claim 1, wherein a fluorescent material used in said discharge lamp has persistence characteristics such that optical output of the discharge lamp is reduced to a half in 1.5 milliseconds or more.

11. A ballast for a discharge lamp according to claim 1, further comprising a dimmer connected between said discharge lamp and an AC power source.

* * * * *